US005205977A

United States Patent [19]

Green et al.

[11] Patent Number: 5,205,977

[45] Date of Patent: Apr. 27, 1993

[54] METHOD OF SECURING AN INSERT IN A SHELL

[75] Inventors: Eric T. Green, Hummelstown; James P. Scholz, New Cumberland, both of Pa.

[73] Assignee: AMP Incorporated, Harrisburg, Pa.

[21] Appl. No.: 758,240

[22] Filed: Sep. 10, 1991

Related U.S. Application Data

[60] Continuation of Ser. No. 578,928, Sep. 6, 1990, abandoned, which is a division of Ser. No. 401,356, Aug. 31, 1989, Pat. No. 4,976,634.

[51] Int. Cl.[5] ..... B29C 65/54

[52] U.S. Cl. ..... 264/261; 156/292; 156/304.2; 264/263; 264/272.11; 264/325; 264/DIG. 64

[58] Field of Search ..... 264/259, 261, 263, 248, 264/272.11, 272.13, 272.14.272.15, 325, DIG. 64; 156/306.6, 306.9, 81, 155, 292, 304.2

[56] References Cited

U.S. PATENT DOCUMENTS

| | | | |
|---|---|---|---|
| 2,949,642 | 8/1960 | Lieberman . | |
| 3,518,339 | 6/1970 | Goff | 264/263 |
| 3,705,831 | 12/1972 | Sayre et al. | 264/263 |
| 3,772,637 | 11/1973 | Paullus et al. | 439/589 |
| 3,808,073 | 4/1974 | Navarre | 156/69 |
| 3,816,641 | 6/1974 | Iversen . | |
| 3,963,295 | 6/1976 | Askman e al. | 439/730 |
| 3,970,352 | 7/1976 | Dorrell et al. | 439/276 |
| 4,276,108 | 6/1981 | Gellatly et al. | 264/263 |
| 4,335,932 | 6/1982 | Herrmann, Jr. | 439/936 |
| 4,417,736 | 11/1983 | Herrmann, Jr. | 439/281 |
| 4,684,187 | 8/1987 | Rudy, Jr. et al. . | |
| 4,748,294 | 5/1988 | Bartell et al. | 264/272.11 |

FOREIGN PATENT DOCUMENTS

| | | | |
|---|---|---|---|
| 0187381 | 7/1986 | opean Pat. Off. . | |
| 0292118 | 11/1988 | opean Pat. Off. . | |
| 2562336 | 3/1984 | France . | |
| 294522 | 12/1985 | Japan | 264/263 |
| 505233 | 5/1939 | United Kingdom | 264/263 |

OTHER PUBLICATIONS

Multi-Seals Brochure, Unifoms-The Unique One Part Epoxy Preform Line, 1982, Multi-Seals, Inc., Manchester, Ct.

Multi-Seals Technical Data Sheet, Uniforms, "DC-001, DC-002 and DC-003 One Component Epoxy High Flow Solid Encapsulation and Sealing Compounds" Rev. Dec. 11, 1984. Multi Seals, Inc. Manchester, Ct.

*Primary Examiner*—Jeffery Thurlow
*Assistant Examiner*—Mathieu Vargot
*Attorney, Agent, or Firm*—Anton P. Ness

[57] ABSTRACT

A plastic connector housing (50) having a plurality of contacts secured therewithin is securable to and within a protective metal shell (12) without a bead of liquid adhesive placed therebetween during assembly, by forming a shallow peripheral channel (76) in a housing flange forward surface (74) and a shallow recess (30) in an abutting rearward surface (24) of a corresponding shell flange (18), the channel and recess defining a confined seal seat (80) extending around the housing body section (70). Lengths of solid sealant preforms (90) such as of epoxy are disposed along the channel during assembly, and the shell (12) and housing (50) held together and heated, thereby melting the sealant to flow and bond to the surfaces of the channel and recess, both joining the housing (50) to the shell (12) and forming a hermetic seal (92) along the interface therebetween, recessed from outer surfaces of the connector (10).

11 Claims, 4 Drawing Sheets

METHOD OF SECURING AN INSERT IN A SHELL

This application is a continuation of application Ser. No. 07/578,928 field Sep. 6, 1990, now abandoned, which was a divisional of application Ser. No. 07/401,356 filed Aug. 31, 1989 now U.S. Pat. No. 4,976,634.

FIELD OF THE INVENTION

This relates to the field of electrical connectors and more particularly to connectors having a housing within a shell member.

BACKGROUND OF THE INVENTION

Certain electrical connectors have a plurality of terminals secured within a dielectric housing member which in turn is secured within a surrounding metal shell member, such as for physical protection and also for shielding against electromagnetic interference (EMI). Such a shell may be adapted to be mounted to a bulkhead to extend through a cutout, and the connector must define a hermetic seal between one side of the bulkhead and the other, by necessity including complete peripheral sealing of the insert to the surrounding shell.

One conventional technique of securing the housing within the shell is to provide a plurality of latches for mechanically securing the two members together, and also providing a bead of liquid adhesive material completely around either a forwardly facing surface of the housing or the corresponding rearwardly facing surface of the shell which abuts the housing flange. Application of such liquid adhesive materials is not cost effective because application tools are necessary to dispense the adhesive, the adhesive has a limited shelf life and/or stringent environmental controls are needed therefor, and the application tooling must be frequently cleaned and cared for all of which results in substantial cost of production.

It is desired to provide a method for permanently securing a housing member within a shell member wherein the interface between the members is hermetically sealed.

It is further desired that such a method be economical and simple.

SUMMARY OF THE INVENTION

The present invention comprises a method for bonding a housing member to and within a protective metal shell member which seals the bonded interface completely peripherally around the housing member. The housing member includes a plurality of passageways extending from a forward mating face to a rearward face thereof, within which are disposed respective electrical terminals The shell member defines an insert-receiving cavity in communication with the rearward face and the forward face thereof, and is adapted to receive the body section of the housing member inserted from rearwardly thereof until the housing mating face is proximate the shell forward face and the contact sections of the terminals are exposed therealong to be matingly engaged by contact sections of a corresponding connector upon mating. A rear flange of the housing member extends laterally outwardly from the body section and peripherally therearound defining a forwardly facing surface abutting the rearward face of the shell member upon full housing insertion.

Defined into the forwardly facing flange surface is a shallow channel adjacent the body section of the housing, the channel being formed preferably by rectilinear surfaces. Formed into the rearward shell face is a corresponding shallow recess extending outwardly from the insert-receiving cavity and comprised preferably of rectilinear surfaces, opposing the shallow channel. The shallow channel and opposing shallow recess define a preferably rectangular seal seat. Preforms of solid sealant material such as epoxy resin having rectangular cross-section are disposed within the seal seat upon assembly of the housing into the shell. The assembly is subjected to thermal energy of sufficient amount during which the sealant preforms melt and flow along and bond to the rectilinear surfaces of both the shallow housing channel and the shallow shell recess, bonding the housing to the shell and simultaneously sealing the bonded interface.

It is an objective of the present invention to provide a sealed bond around the housing within the shell.

It is also an objective to provide such a sealed bond remote from outside surfaces of the connector.

It is a further objective to provide such a sealed bond without using fluid adhesive materials of limited shelf life needing to be dispensed by tools needing to be cleaned.

An embodiment of the present invention will now be described with reference to the accompanying drawings.

DETAILED DESCRIPTION OF THE PREFERRED EMBODIMENTS

Figure 1:
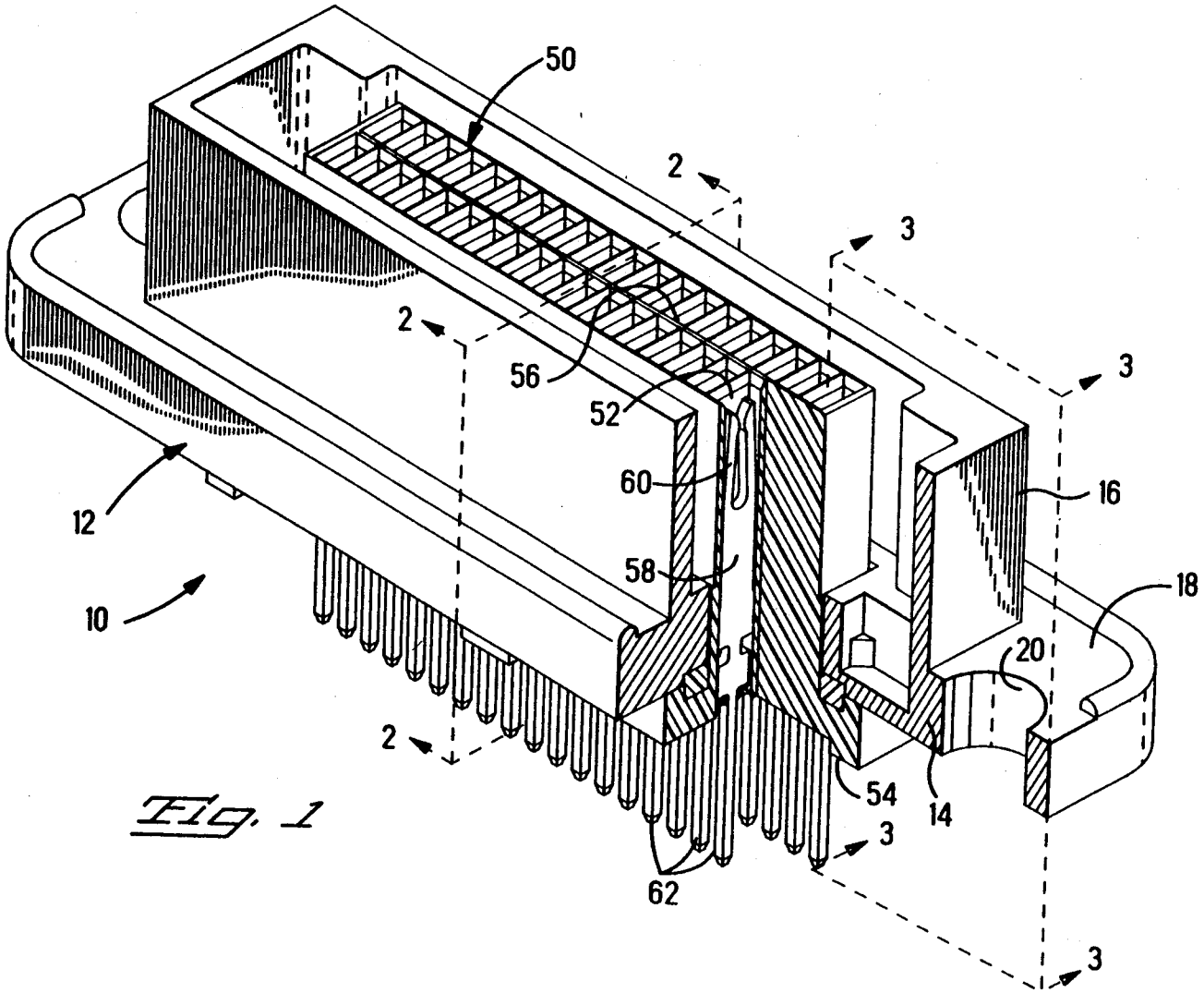
FIG. 1 is an isometric view of a connector assembly having a housing insert within a shell, partly in section to display the shell and housing structure and the interface therebetween, and a terminal thereof.

Connector assembly 10 includes a conductive shell member 12 and a dielectric housing member 50 inserted and bonded therewithin. Housing 50 includes a plurality of passageways 52 extending from a rear face 54 to a forward or mating face 56, within each of which is secured a respective electrical contact 58. Each contact 58 includes a forward contact section 60 exposed along mating face 56 to be electrically engaged by a corresponding contact means of a mating electrical article, and a rearward contact section 62 extending from rear face 54 to be electrically engaged by another corresponding contact means of another electrical article. In the present embodiment, forward contact section 60 is a tuning fork-shaped socket into which a blade contact is to be received, and rearward contact section 62 is a post for either insertion and soldering into a respective plated through-hole of a printed circuit board (not shown), or being wrapped by or soldered to individual conductor wires. Each post exit 64 along rear face 54 includes sealant material 66 sealing about the contact post within the respective passageway 52.

Figure 3:
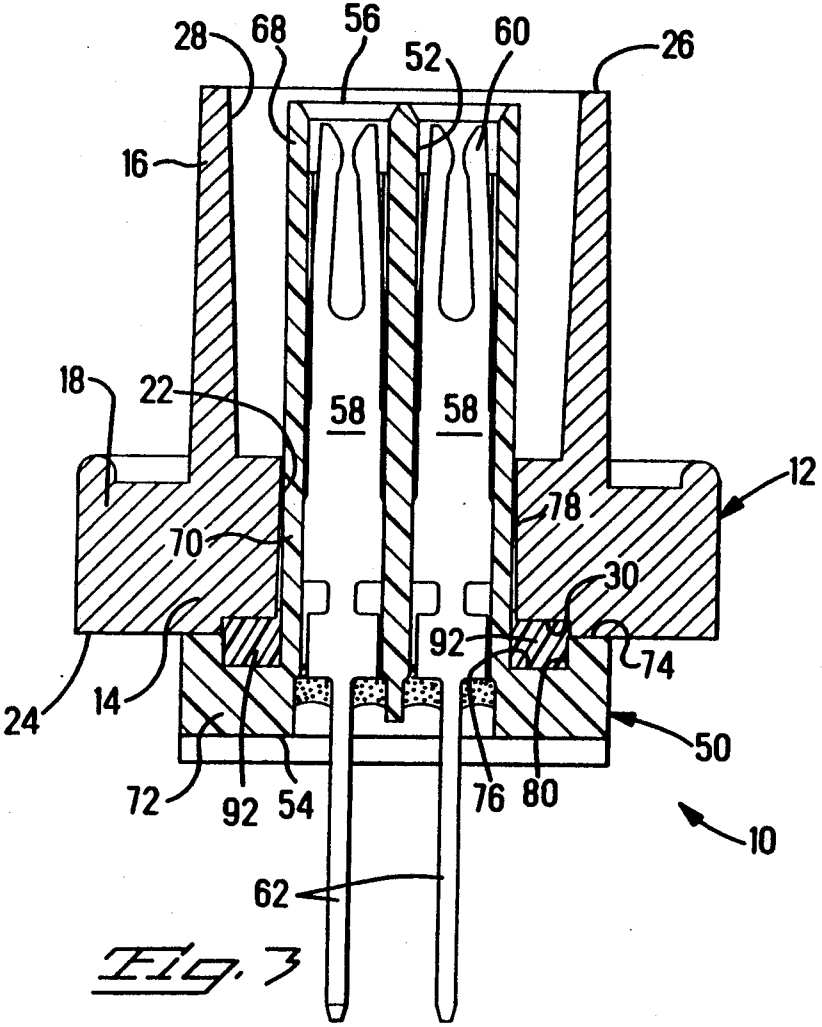
FIGS. 2 and 3 are longitudinal section views of the assembly of FIG. 1 taken along planes 2—2—2—2 and 3—3—3—3 thereof.
Figure 2:
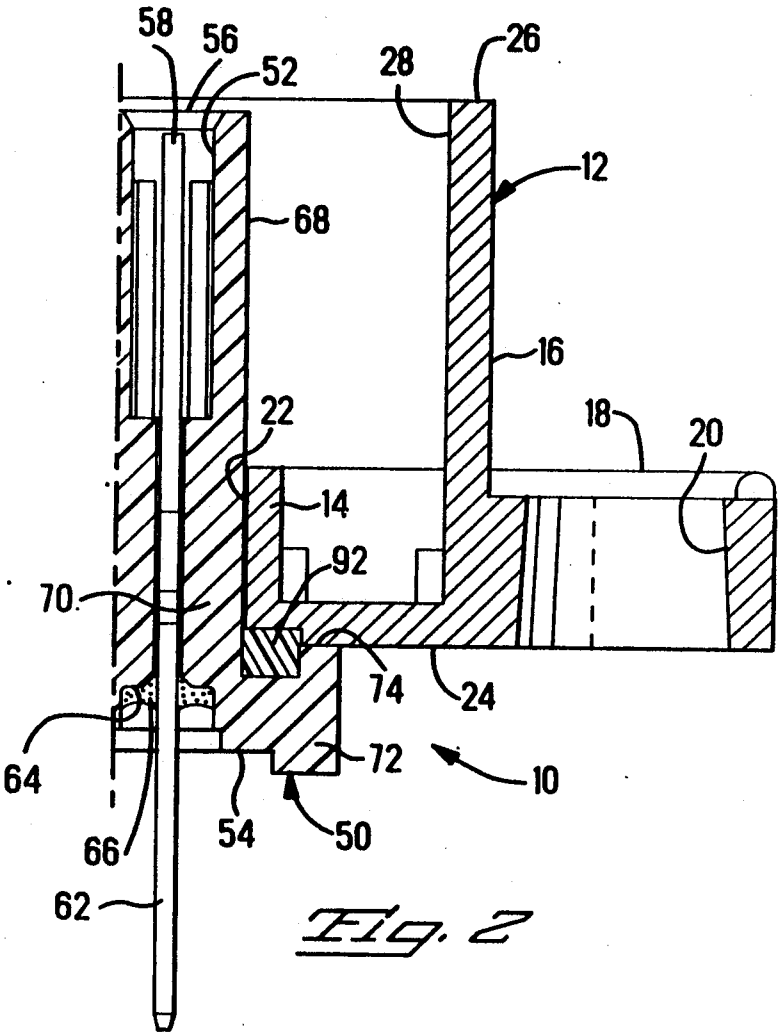
Figure 4:
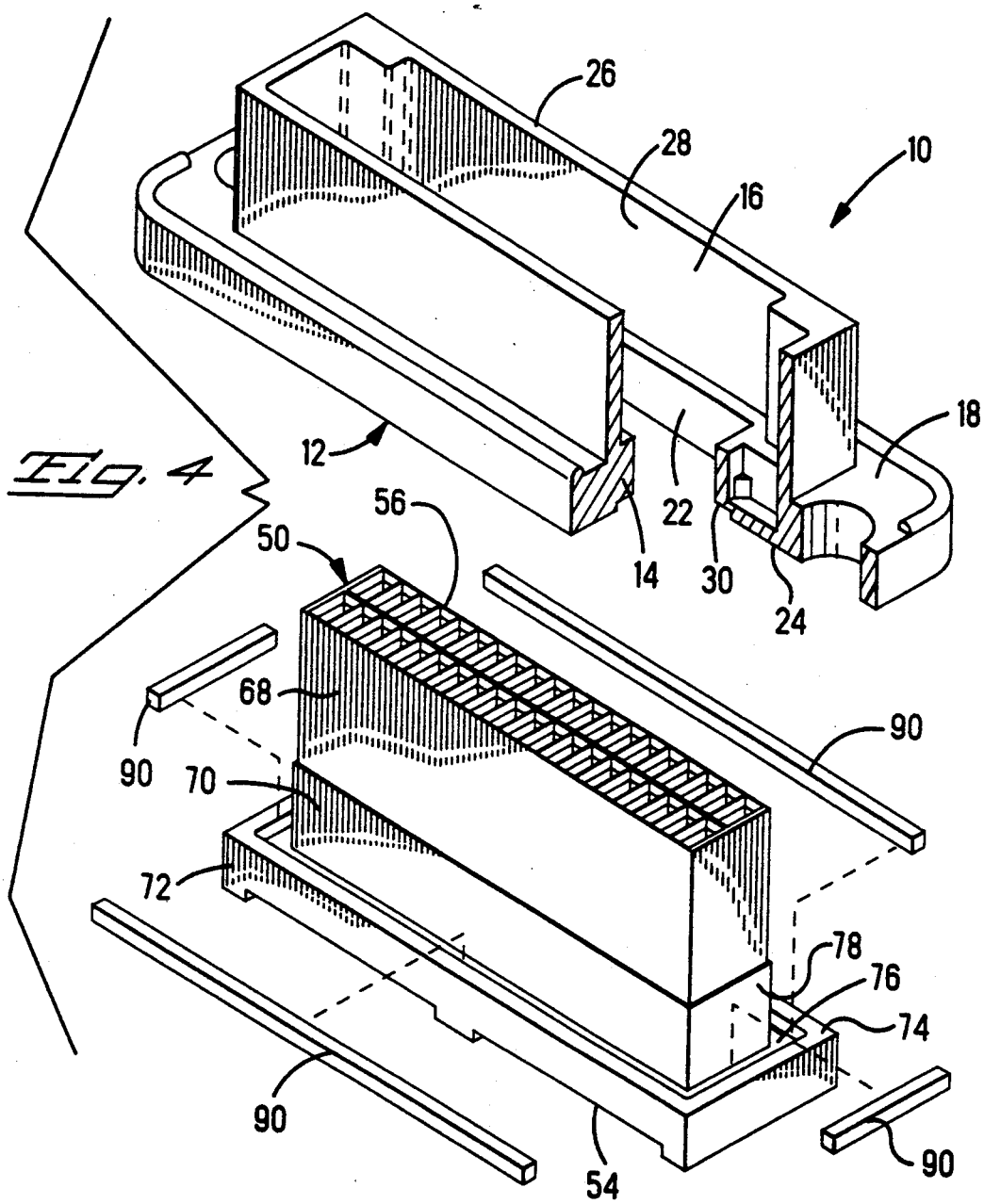
FIG. 4 is an isometric view of the connector assembly with the housing insert exploded from the shell and the sealant preforms exploded from the shallow channel of the housing insert.

Shell 12 may be metal, for example die cast and/or machined of aluminum and then anodized or plated, and includes a hood section 14 extending forwardly from body section 16, and a flange section 18 extending peripherally around and outwardly from body section 16 and providing for mountability by fasteners (not shown) secured in apertures 20 to a bulkhead (not shown) at a cutout therethrough either along the forward face of flange section 18 or the rear face, with or without a gasket. As shown, shell 12 also includes large lateral apertures in which key and key retention members may be secured. Referring particularly to FIGS. 2 to 4, body section 16 includes an insert-receiving aperture 22 shaped and dimensioned to receive housing insert 50 therethrough from rear shell face 24.

Housing insert 50 may be molded of plastics, of for example high performance liquid crystalline polymer resins such as wholly aromatic polyesters, sold by Celanese Specialties Operations of Summit, NJ, or by DARTCO Mfg., Inc. of Paramus, NJ. Housing insert 50 includes a plug section 68 extending forwardly from body section 70, and a flange section 72 extends peripherally around body section 70 and outwardly therefrom along rear face 54. Hood section 16 of shell 12 extends to a leading end 26 and is spaced outwardly from housing plug section 68 to define a peripheral cavity 28 therearound to receive thereinto a corresponding hood-shaped forward housing section of a corresponding mating electrical connector (not shown). Flange section 72 of housing 50 includes a forwardly facing surface 74 adapted to abut rear face 24 of shell 12 peripherally around housing 50.

In the present invention, a shallow channel 76 is formed into forwardly facing surface 74 of housing flange section 72 adjacent outer surface 78 of body section 70 and extending completely peripherally therearound. A shallow recess 30 is formed into rear face 24 of shell 12 in communication with insert-receiving aperture 22 of shell body section 14, extending completely peripherally therearound and directly opposing shallow channel 76. When housing 50 is inserted into shell 12 and forwardly facing surface 74 abuts rear shell face 24, shallow channel 76 and shallow recess 30 define a rectangular seal seat 80.

Preforms 90 of solid sealant material are disposed within seal seat 80 which when melted will flow and wet along all surfaces of seal seat 80 and along incremental gaps in communication with seal seat 80 such as between outer body section surface 78 and insert-receiving aperture 22, and upon cooling the sealant material will bond thereto defining an assured joint 92 between shell 12 and housing 50 and also forming a hermetic seal therebetween extending continuously around housing 50 Sealant melting can be attained by placement of the shell/housing/preform assembly into an oven at elevated temperatures.

Figure 5:
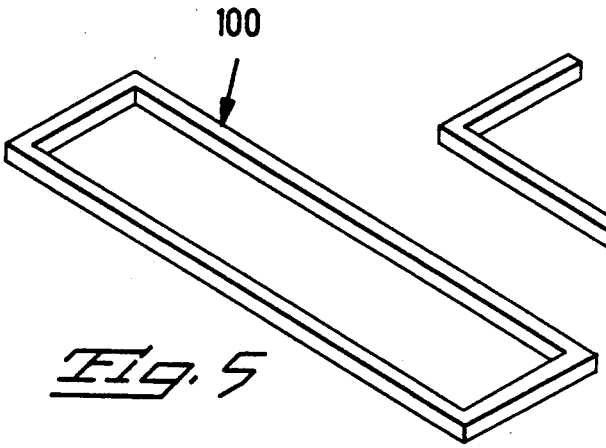
FIGS. 5 and 6 are alternative embodiments of sealant preforms.
Figure 6:
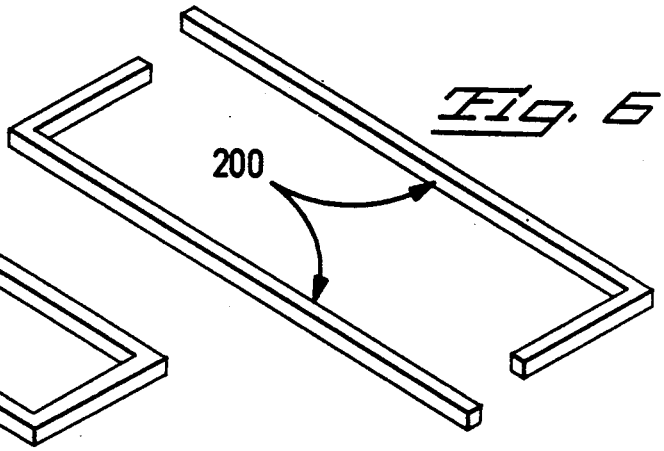

FIG. 4 shows the method of assembly of the present invention in which shell 12 is placed over and around housing 50 after appropriate lengths of sealant preforms 90 are placed into and along shallow channels 76, with housing 50 shown without contacts therein. FIGS. 5 and 6 illustrate other shapes of sealant preforms usable with the method of the present invention; in FIG. 5 a continuous rectangle 100 is shaped to be placed over the housing plug section and into the shallow channel; and in FIG. 6 a pair of L-shapes 200 are more easily placeable into the shallow channel.

Preforms of sealant material may be of the type manufactured by Multi-Seals, Inc., of Manchester, CT under the trademark UNI-FORMS. The preforms are of a solid unfilled one-component epoxy material having very high flow properties (or low melt viscosity) with melting points at about from 200° F. to 212° F.; the molten material flows into small openings or around complex parts and then cures very rapidly into a tough cross-linked epoxy having excellent insulation characteristics and resistance to heat and moisture. Compounds UNI-FORM DC-001 and DC-002 have good flow characteristics, while DC-003 and DC-004 include a wetting agent to enhance flow along surfaces, which is preferred. The preforms are said to be custom manufacturable in any size and shape, and remain in the preform shape during long storage at room temperature.

Figure 7A:
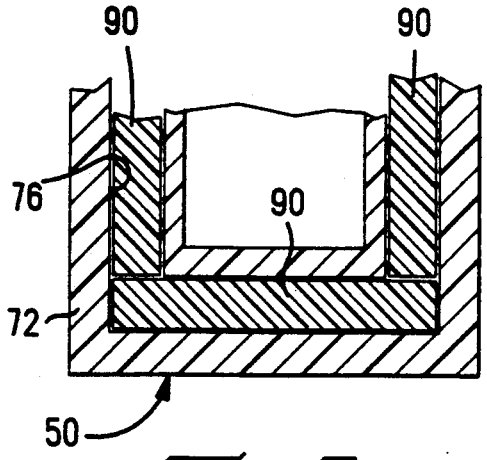
FIGS. 7A and 7B are enlarged cross-sectional views of the housing along a seal seat showing sealant preforms within the shallow housing channel before and after being melted and thereafter flowing and sealing.
Figure 7B:
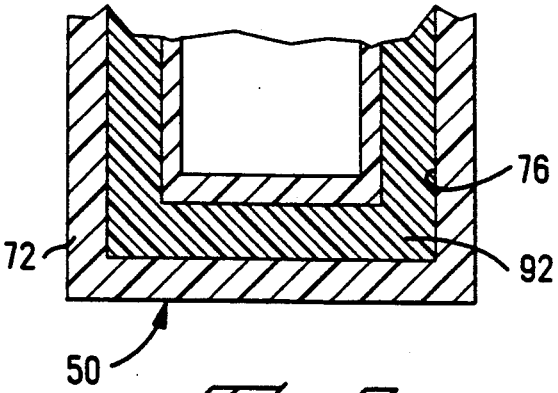

FIGS. 7A and 7B are enlarged plan views of lengths of the sealant preforms 90 disposed within shallow channels 76 at an end of housing 50 and sectioned, both before and after being subjected to melting Preforms 90 are dimensioned to be just smaller than the width and length of shallow channel 76 to be easily disposed therein; the preforms tend to be somewhat brittle and frangible, not appropriate to be inserted in a tight fit into channel 76. Underdimensioning of preforms 90 enables placement thereof within said seal seat without compression or force and also allows for incremental variations in preform dimensions during manufacturing thereof, and also of dimensions of the insert channel and the shell recess.

Figure 8A:
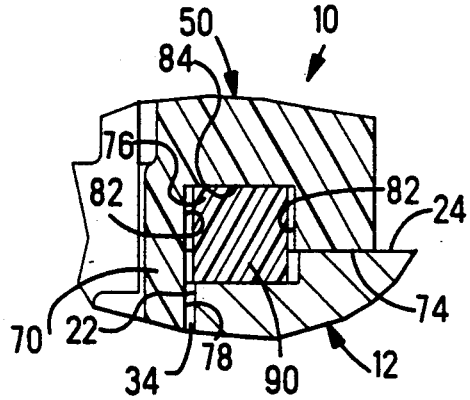
FIGS. 8A and 8B are enlarged cross-section views through a seal seat showing a preform therein before and after being melted and thereafter flowing and sealing.
Figure 8B:
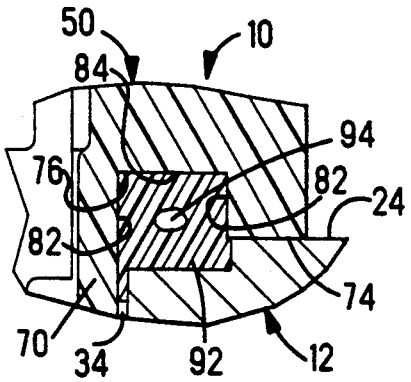

FIGS. 8A and 8B are enlarged views through seal seat 80 before and after melting the preforms 90. Again, each preform 90 is dimensioned to be just smaller than the width of shallow channel 76, between side surfaces 82; the height of preform 90 is also shown in FIG. 8A to have been selected to be just less than the height between channel bottom 84 and recess surface 32 after shell 12 has been placed over housing 50 with rear shell face 24 abutting surface 74 of housing flange section 70. Also seen in FIG. 8A is an incremental gap 34 between outer surface 78 of housing body section 70 and the inwardly facing surface of insert-receiving aperture 22 of shell body section 14. It is believed preferable to invert the shell/housing/preform assembly to facilitate by gravity the flow of molten sealant material into incremental gap 34. Preferably a clamping arrangement holds shell 12 and housing 50 firmly against each other during melting and curing of the sealant material Also preferably, surface 74 of housing flange section 70 is formed to be precisely coplanar therearound, and abutting surface 24 of shell 12 is machined to be precisely coplanar to minimize any interfacial gap between the abutting surfaces of housing 50 and shell 12. With seal seat 80 located inwardly from outer surfaces of the finished connector 10, the seal is physically protected; also, the sealant material is confined against seeping to and along the outer surfaces.

Because preforms 90 are slightly smaller than seal seat 80 formed by shallow channel 76 and shallow recess 30, air occupies the space between the surfaces of the housing 50, the shell 12 and the preforms 90. Since the sealant has excellent flow properties, when melted the epoxy will wet along surfaces of the channel the recess and also flow into and along a portion of incremental gap 34. Upon curing the sealant material 92 solidifies along all housing and shell surfaces adjacent seal seat 80 and seals thereagainst peripherally entirely around housing body section 70, but generally would not expand appreciably if at all to occupy after curing a greater cross-sectional area than that of the initial preform. The air initially between the solid surfaces tends to migrate in the molten sealant material to the center of seal seat 80 to form a resultant incidental cavity 94. Any resultant air cavity 94 would be small and remote from seal seat surfaces and therefore be innocuous and not detract from the seal formed by the cured epoxy 92 between the housing and the shell.

Figure 9A:
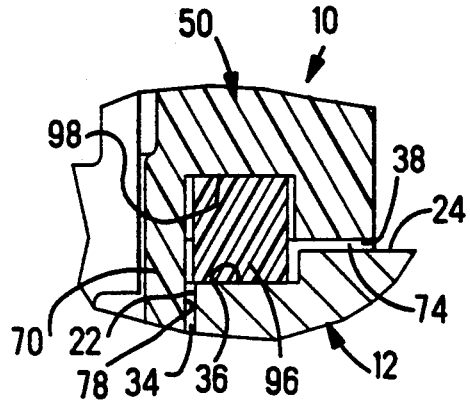
FIGS. 9A and 9B are similar to FIGS. 8A and 8B showing an alternative method.
Figure 9B:
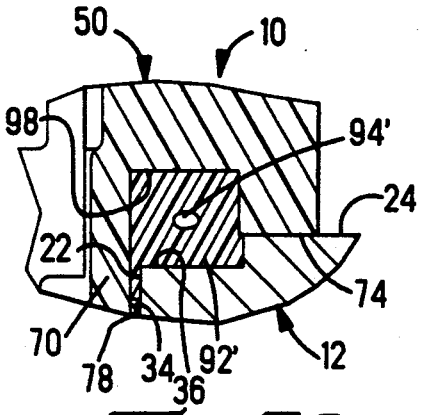

FIGS. 9A and 9B illustrate a slightly different embodiment of the present invention. In FIG. 9A preform 96 is selected to have a vertical dimension slightly larger than the distance between shallow channel bottom surface 98 and shallow recess surface 36 when shell 12 and housing 50 are brought together, thereby holding the shell and housing slightly apart temporarily forming a gap 38 between forwardly facing surface 74 of housing flange section 70 and rear face 24 of shell 12. Upon melting, the sealant material will flow along the surfaces of seal seat 80 and because the shell and housing are under a clamping force gap 38 will close perforce In this embodiment the amount of air remaining in the cross-section of seal 92' will be reduced, as illustrated by small central air cavity 94', or be substantially or completely eliminated. Optionally the assembly could be placed under vacuum to remove air completely during the curing cycle.

It is believed that an assured seal 92,92' best results when the surfaces defining seal seat 80 are rectilinear flat surfaces than if radiused, in order to result in well defined fillets and also increase the solid surface area between the seal 92,92' and the shell and housing surfaces Variations may be made such as forming a series of small notches or undercuts in the shallow channel or in the shallow recess to increase the surface area or to form mechanical joints as well as bonding of the seal 92,92' to the shell and housing It may also desired to prepare the surfaces of the shallow channel and the shallow recess to enhance bonding of the epoxy to the housing and shell members. Such modifications and variations are within the spirit of the invention and the scope of the claims.

What is claimed is:

1. A method of joining an insert to a shell at an interface and simultaneously sealing the interface therebetween, the insert being of the type including a body section disposed within and extending axially along an insert-receiving aperture extending axially through the shell from a forward end to a rearward end thereof, the insert body section including an outwardly facing surface peripherally surrounded by a continuous portion of the shell upon assembly, and the insert including a flange section extending transversely outwardly from the outwardly facing surface of a rearward portion of the body section and peripherally therearound and having a forwardly facing surface section abutting a rearwardly facing surface section of a rearward portion of the shell continuously around the insert flange section, comprising the steps of:

forming a channel in said forwardly facing surface section of said insert flange section extending transversely outwardly from said insert body section and opposing said rearwardly facing shell surface section;

forming an opposing recess in said rearwardly facing shell surface section opposed from said channel when said insert is placed within said shell, said recess and said channel defining a seal set peripherally surrounding said body section of said insert and shaped cross-sectionally to eventually contain a bead of cured sealing material;

selecting uncured material having low melt viscosity and good ability to flow along surfaces upon being liquefied, and having good adhesive characteristics upon curing;

disposing said selected material in one of said channel and said recess substantially entirely therearound prior to assembling said insert and said shell, obviating any need for openings providing access to said seal seat for injection of material;

placing said insert within said shell with said forwardly facing insert surface section at least adjacent said rearwardly facing shell surface section; and melting said selected material so that it liquefies, flows along all surfaces defining said seal sat, and cures thereby bonding said insert to said shell both defining the inert-to-shell joint and defining a hermetic seal entirely peripherally around the interface therebetween.

2. A method as set forth in claim 1 wherein said insert and said shell are pressed together during said melting of said selected material 3. A method as set forth in claim 1 wherein said channel and said recess are formed having rectilinear surfaces.

4. A method as set forth in claim 1 wherein said channel is disposed adjacent said body section, and said recess extends outwardly from said insert-receiving aperture of said shell.

5. A method as set forth in claim 4 wherein after said placing step, said assembly of said insert and shell and selected material is oriented such that said rearwardly facing shell surface faces upwardly, whereby upon melting said selected material is assisted by gravity to flow downwardly between an incremental gap between an outer surface of said insert body section and an inwardly facing surface defining said insert-receiving aperture of said shell.

6. A method as set forth in claim 1 wherein said selected material initially comprises a solid performed into a selected shape adapted to be placed within said one of said channel and said recess.

7. A method as set forth in claim 6 wherein said preformed solid is dimensioned and shaped to fit entirely within said seal seat when said insert and shell are placed together so that said forwardly facing insert surface section abuts said rearwardly facing shell surface section prior to melting said selected material.

8. A method as set forth in claim 7 wherein said preformed solid is dimensioned to be slightly less in cross-section than the cross-section of said seal seat when said insert and said shell are placed together, enabling placement of said preformed solid within said seal seat without compression or force.

9. A method as set forth in claim 6 wherein said insert and said shell are pressed together during said melting of said selected material, and said preformed solid is dimensioned and shaped to be positioned within said one of said channel and said recess and having a height prior to melting sufficient to incrementally space apart said forwardly facing insert surface section and said rearwardly facing shell surface section upon said insert and said shell being initially placed together

10. The method as set forth in claim 1 wherein both said shell and said insert are free of openings in communication between said seal seat and any outer surface, whereby said seal seat is entirely enclosed by said shell and said insert and environmentally isolated.

11. A method as set forth in claim 1 wherein said channel and said recess are formed to define a rectangular seal seat cross-section.

* * * * *

UNITED STATES PATENT AND TRADEMARK OFFICE

CERTIFICATE OF CORRECTION

PATENT NO. : 5,205,977

DATED : April 27, 1993

INVENTOR(S) : Eric T. Green et al.

It is certified that error appears in the above-identified patent and that said Letters Patent is hereby corrected as shown below:

In claim 1, column 6, line 15, delete "liquefied" and insert --liquified--.

In claim 1, column 6, line 26, delete "liquefies" and insert --liquifies--.

In claim 1, column 6, line 27, delete "sat" and insert --seat--.

In claim 6, column 6, line 52, delete "performed" and insert --preformed--.

In claim 9, column 7, line 7, insert --.-- after 'together'.

Signed and Sealed this

Second Day of November, 1993

Bruce Lehman

*Attest:*

BRUCE LEHMAN

*Attesting Officer*

*Commissioner of Patents and Trademarks*